US008973757B2

(12) United States Patent
Fimbrez

(10) Patent No.: US 8,973,757 B2
(45) Date of Patent: Mar. 10, 2015

(54) ACCESSORY CONTAINER AND CHANGING TABLE

(71) Applicant: Nicholas T. Fimbrez, Atwater, CA (US)

(72) Inventor: Nicholas T. Fimbrez, Atwater, CA (US)

( * ) Notice: Subject to any disclaimer, the term of this patent is extended or adjusted under 35 U.S.C. 154(b) by 0 days.

(21) Appl. No.: 13/924,742

(22) Filed: Jun. 24, 2013

(65) Prior Publication Data

US 2014/0374305 A1 Dec. 25, 2014

(51) Int. Cl.
*B65D 81/02* (2006.01)
*B68G 5/00* (2006.01)
*A45C 9/00* (2006.01)

(52) U.S. Cl.
CPC ... *A45C 9/00* (2013.01); *Y10S 5/947* (2013.01)
USPC ..... 206/581; 190/2; 5/947

(58) Field of Classification Search
USPC ..... 5/655, 947, 420, 482; 190/1, 2, 102, 190/107, 122, 123; 206/581, 576, 577, 570, 206/823
See application file for complete search history.

(56) References Cited

U.S. PATENT DOCUMENTS

| | | | | |
|---|---|---|---|---|
| 2,203,538 | A * | 6/1940 | Meilink | 108/48 |
| 4,164,275 | A * | 8/1979 | Davis | 190/2 |
| 5,615,433 | A | 4/1997 | Martin | |
| 5,649,658 | A * | 7/1997 | Hoffman et al. | 224/576 |
| 5,868,227 | A * | 2/1999 | Garcia | 190/112 |
| 6,298,993 | B1 * | 10/2001 | Kalozdi | 206/581 |
| 6,390,260 | B1 * | 5/2002 | Roegner | 190/109 |
| 6,694,552 | B1 | 2/2004 | Vickers | |
| 7,891,034 | B2 * | 2/2011 | Smith | 5/655 |
| 8,001,637 | B1 * | 8/2011 | Gant et al. | 5/655 |
| 8,276,228 | B1 * | 10/2012 | Gant et al. | 5/655 |
| 8,490,230 | B2 * | 7/2013 | Rovin | 5/655 |
| 8,677,534 | B2 * | 3/2014 | Gant et al. | 5/655 |
| 2002/0074251 | A1 * | 6/2002 | Hirshberg | 206/315.1 |
| 2006/0254952 | A1 * | 11/2006 | Trevino et al. | 206/581 |
| 2009/0127045 | A1 * | 5/2009 | Williams et al. | 190/107 |

* cited by examiner

*Primary Examiner* — Jacob K Ackun
(74) *Attorney, Agent, or Firm* — Dale J. Ream

(57) ABSTRACT

An accessory container for containing baby accessories and for changing a baby's diaper when in proximity to a door includes a container member having a bottom wall with rear, front, and side walls extending upwardly therefrom and defining an interior area. A divider panel is positioned in the interior area of the container member so as to divide the interior area into first and second chambers. The front wall is movable between a closed configuration preventing access to the second chamber and an open configuration allowing access to the second chamber. A length adjustable frame assembly is mounted in the second chamber and is selectively movable between a stowed configuration contained in the second chamber and a deployed configuration extending away from the second chamber. A covering is the frame assembly is configured to support a baby on the frame assembly.

11 Claims, 14 Drawing Sheets

ACCESSORY CONTAINER AND CHANGING TABLE

BACKGROUND OF THE INVENTION

This invention relates generally to baby diaper bags and, more particularly, to a baby accessory container for holding baby related supplies and that includes an integrated changing platform that may be selectively hung from a door or side panel of a bathroom door or stall panel.

Changing tables have become more common in public restrooms than in the past. For instance, a table top structure suitable for supporting a baby may be selectively folded down out of a wall or inside a stall for privacy. However, accessible changing tables are still not frequently found in the men's restroom of all public places and are certainly not frequently found outside of major retail stores. Therefore, a man or a woman seeking to change the diaper of a baby from a location not having a changing table faces the undesirable situation of having to lay the baby on the floor or upon some other surface unintended for that purpose. The floor is often the best option in that the caregiver needs both hands free to change the diaper and cannot use them to steady the child on an unstable surface or no surface at all.

Various devices have been proposed for supporting an infant while changing a diaper in contexts other than the comfort of a home environment, such as diaper changing pads or even portable privacy booths. Although assumably effective for their intended purposes, the existing devices still do not provide the convenience of hands free operation nor at a height that does not require the caregiver to bend over or kneel down.

Therefore, it would be desirable to have an accessory carrying apparatus, such as in the form of a diaper bag, having an integrated diaper changing framework that may be suspended from a traditional door or a restroom stall panel. Further, it would be desirable to have an accessory carrying apparatus that may be suspended from a door or panel, adjusted to a comfortable height above a floor surface, and deployed to support an infant during a diaper changing procedure.

SUMMARY OF THE INVENTION

An accessory container for containing baby accessories and for changing a baby's diaper when in proximity to a door or bathroom stall according to a preferred embodiment of the present invention includes a container member having a bottom wall, a rear wall, a front wall opposite the rear wall, and opposed side walls extending between the front wall and the rear wall. The walls define an interior area. A divider panel is positioned in the interior area of the container member so as to divide the interior area into first and second chambers. The front wall is movable between a closed configuration preventing access to the second chamber and an open configuration allowing access to the second chamber. A length adjustable frame assembly is mounted in the second chamber and that is selectively movable between a stowed configuration contained in the second chamber and a deployed configuration extending away from the second chamber. A covering is mounted to the frame assembly configured to support a baby on the frame assembly.

Therefore, a general object of this invention is to provide a baby accessory container configured for carrying baby accessories and integrally including a diaper changing platform.

Another object of this invention is to provide a baby accessory container, as aforesaid, having a hook member that is selectively extensible from the container member and configured to suspend the container from a traditional door or from a door or panel of a public bathroom stall.

Still another object of this invention is to provide a baby accessory container, as aforesaid, having a length adjustable frame assembly is movable between a retracted and stowed configuration in a chamber of the container and an extended configuration extending away from the container.

Yet another object of this invention is to provide a baby accessory container, as aforesaid, having a safety belt connected to the extensible frame assembly (changing table) to prevent a baby from rolling off.

A further object of this invention is to provide a baby accessory container, as aforesaid, that is easy and efficient to suspend from a door or bathroom stall and to deploy the changing table.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
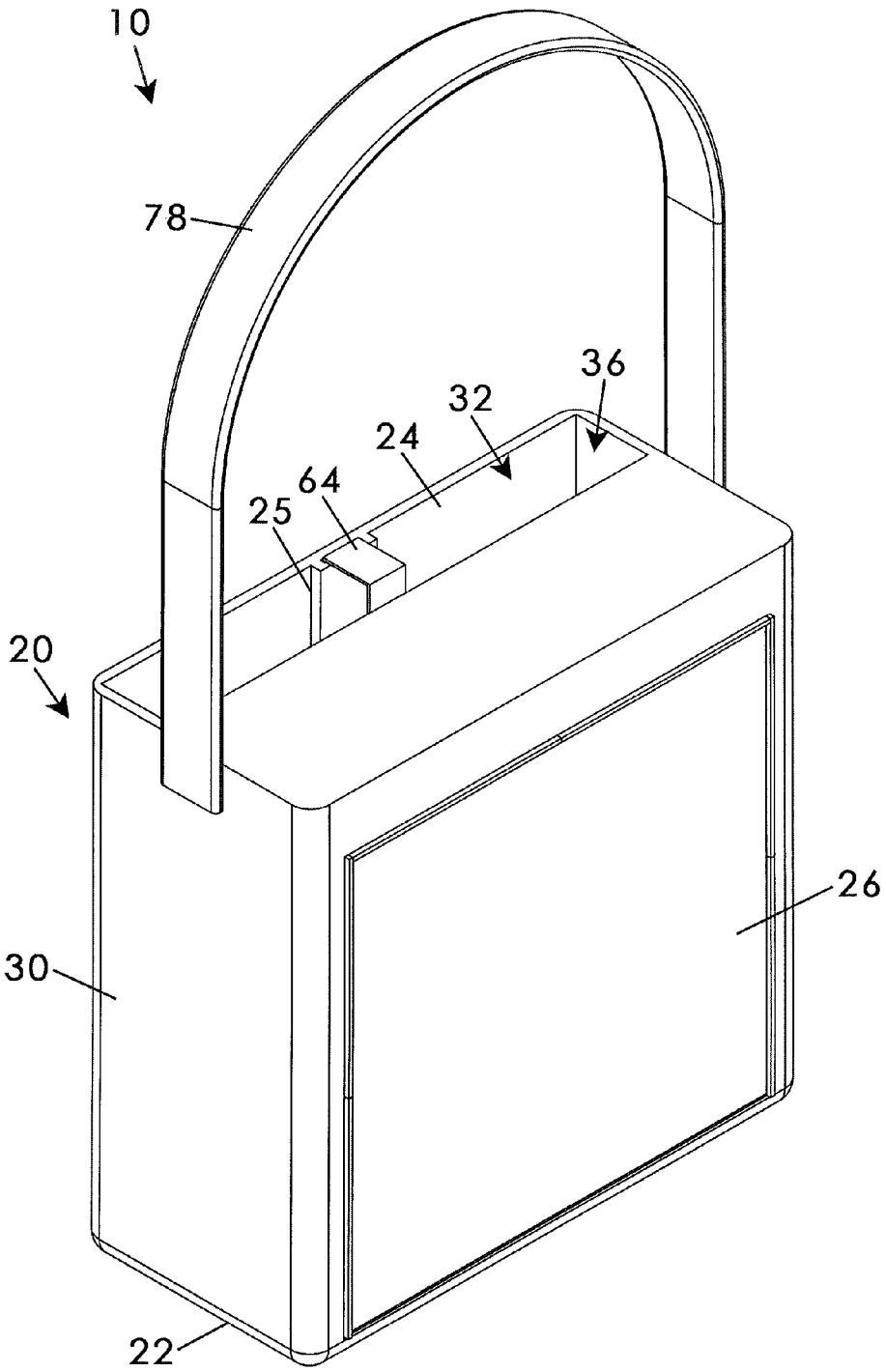
FIG. 1 is a perspective view of an accessory container with integrated changing table according a preferred embodiment of the present invention illustrated in a stowed configuration.

A portable accessory container for carrying baby accessories and for use in changing a baby's diaper by suspending the bag from a door or bathroom stall will now be described with reference to FIGS. 1 to 13*b* of the accompanying drawings. In one embodiment, the accessory container 10 includes a container member 20, a length adjustable frame assembly 40, and a hook member 60.

The container member 20 may be a generally soft-sided bag constructed of flexible material although other firm panel type cases would also be suitable. As will be further described below, the container member 20 may include an open top 32 although closed top diaper bags may also work. More particularly, the container member 20 may include a bottom wall 22, a rear wall 24, a front wall 26 opposite the rear wall 24 and opposed side walls 30 extending between front and rear walls. The rear wall 24, front wall 26, and side walls 30 extend upwardly from the bottom wall 22 so as to define an open interior area. In the embodiment shown in the drawings, respective walls include upper edges that define an open top 32. However, in one embodiment, the respective walls may converge at upper edges or may be connected by a lid or top wall so as to enclose the interior area.

A divider panel 34 may be positioned in the interior area and extend substantially completely between the bottom wall 22 and either the open top 32 or closed top. The divider panel 34 divides the interior area into a first chamber 36 and a second chamber 38. As described below, the second chamber 38 is the open area situated between the divider panel 34 and the front wall 26. As will be described in more detail below, the first chamber 36 is configured and intended to receive baby accessories such as diapers, wipes, toys, clothing, and the like in the manner of a traditional diaper bag. The second chamber 38, by contrast, contains the frame assembly 40 at a stowed configuration, as will be discussed in more detail later, and includes a closed top.

Figure 2:
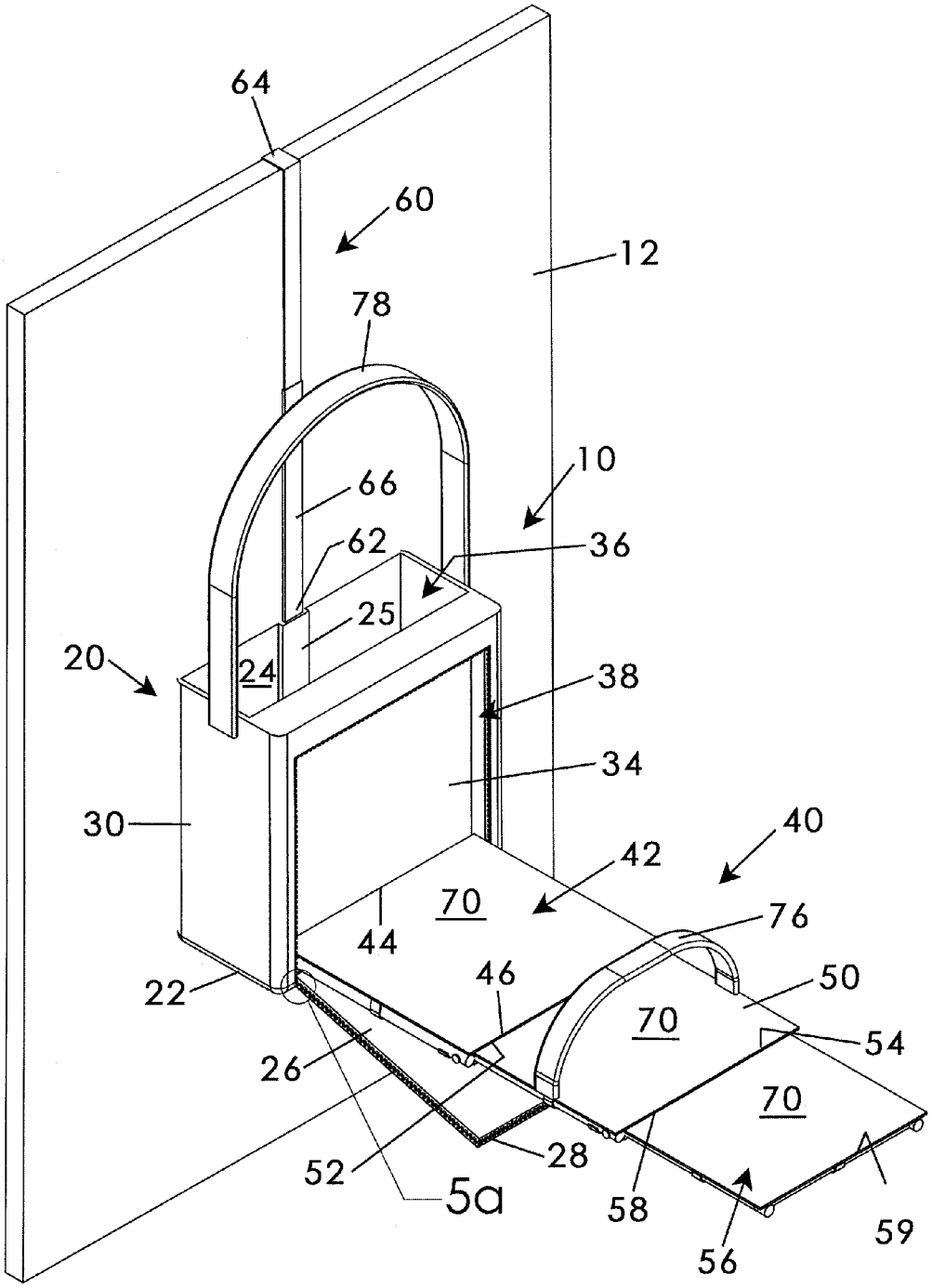
FIG. 2 is another perspective view of the accessory container shown in a deployed configuration and suspended from a door or restroom stall panel.
Figure 3:
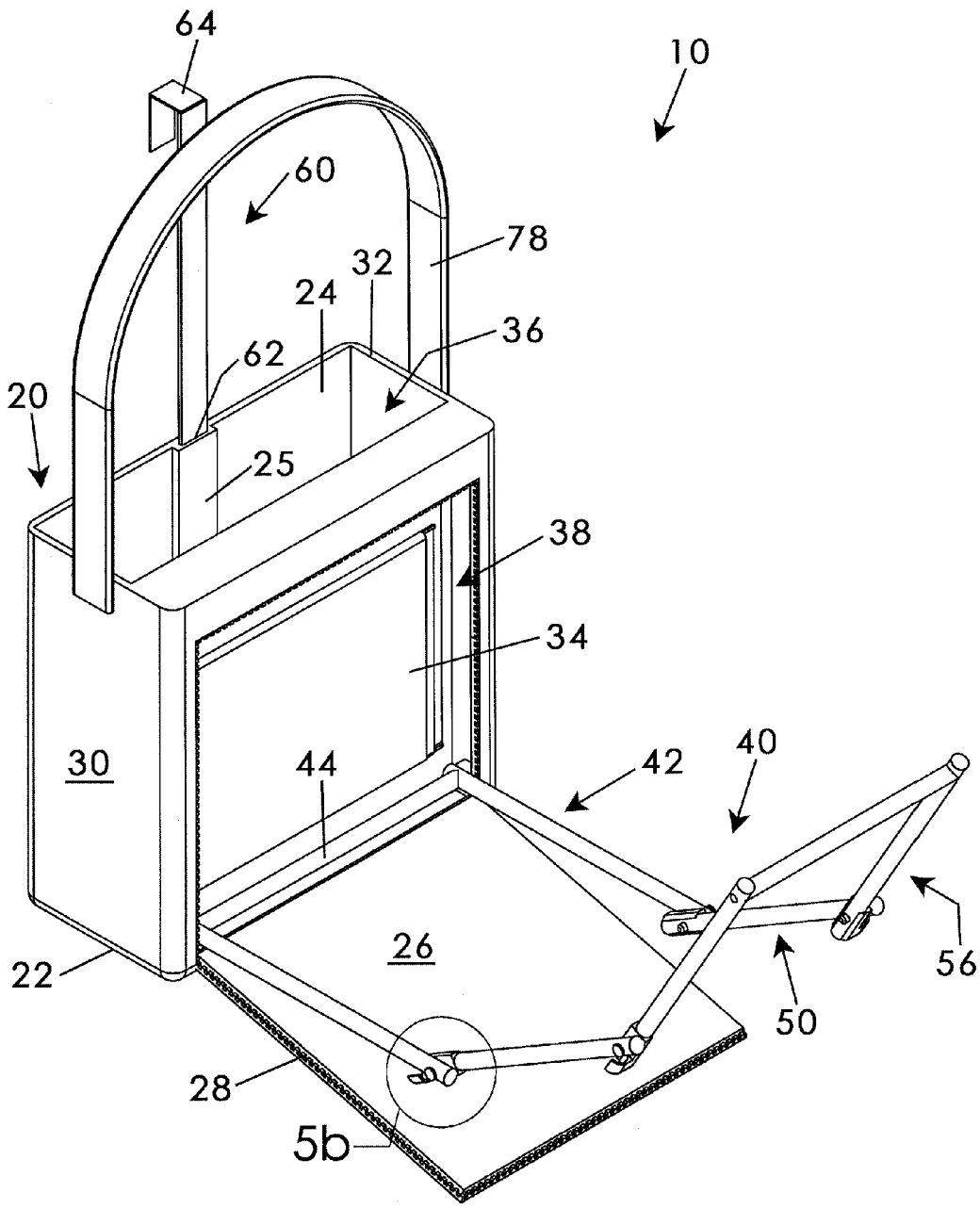
FIG. 3 is another perspective view of the accessory container shown in a partially deployed configuration and with the frame assembly covering removed.

The hook member 60 includes a proximal end 62 operatively coupled to a rear wall 24 of the container member 20. The hook member 60 is movable between a retracted configuration positioned substantially within the first chamber 36 of the interior area (FIG. 1) and an extended configuration positioned substantially outside the interior area (FIG. 3). Further, the rear wall 24 may include a channel 25 having a hollow configuration that is oriented vertically and sized to selectively receive the hook member 60 therein. The hook member 60 is slidably movable within the channel 25 so as to move between the retracted and extended configurations discussed above. The hook member 60 may also have a length adjustable construction that includes a plurality of telescopic portions 66 (FIG. 2). The hook member 60 includes a distal end 64 having a generally inverted U-shaped configuration complementary to the configuration of the top of a traditional door or to an upper edge of a bathroom stall door or panel. In use, the distal end 64 of the hook member 60 may be coupled to a door 12 or stall panel so as to suspend the container member 20 therefrom prior to deploying the frame assembly 40 for use as a changing table (FIG. 2).

The front wall 26 is movable between a closed configuration that precludes access to the second chamber 38 (FIG. 1) and an open configuration that allows access to the second chamber 38 (FIG. 2). More particularly, a lower edge of the front wall 26 may be fixedly attached to the container member 20 proximate the bottom wall 22 and the side and upper edges of the front wall 26 preferably are releasably coupled with a zipper 28. Accordingly, the front wall 26 is held at the closed configuration when the zipper 28 is actuated and the front wall 26 is at an open configuration when the zipper 28 is released.

The frame assembly 40 includes a first end 44 mounted in the second chamber 38 such that the entire frame assembly 40 is situated therein when at a stowed configuration (FIG. 6*b*) and extends outwardly from the second chamber 38 at an extended configuration (FIG. 2). One embodiment of the frame assembly 40 is illustrated in FIG. 3 where it is shown partially extended from the second chamber 38. The frame assembly 40 in this embodiment includes generally tubular frame members separated from one another and defining respective voids therebetween that may be spanned with a covering 70 as described below. More particularly, the frame assembly 40 includes at least a first section 42 and a second section 50. For purposes of the illustrations, the first end 44 of the frame assembly 40 is also a first end of the first section 42. The first section 42 includes a second end 46 opposite the first end 44. The second section 50 includes a first end 52 pivotally coupled to the second end 46 of the first section 42. The second section 50 may include a second end 54 opposite the first end 52. In one embodiment, the frame assembly 40 may include a third section 56. The third section 56 may include a first end 58 pivotally coupled to the second end 54 of the second section 50. The third section 56 may then include a second end 59 that is a terminal or distal end of the frame assembly 40.

Figure 6A:
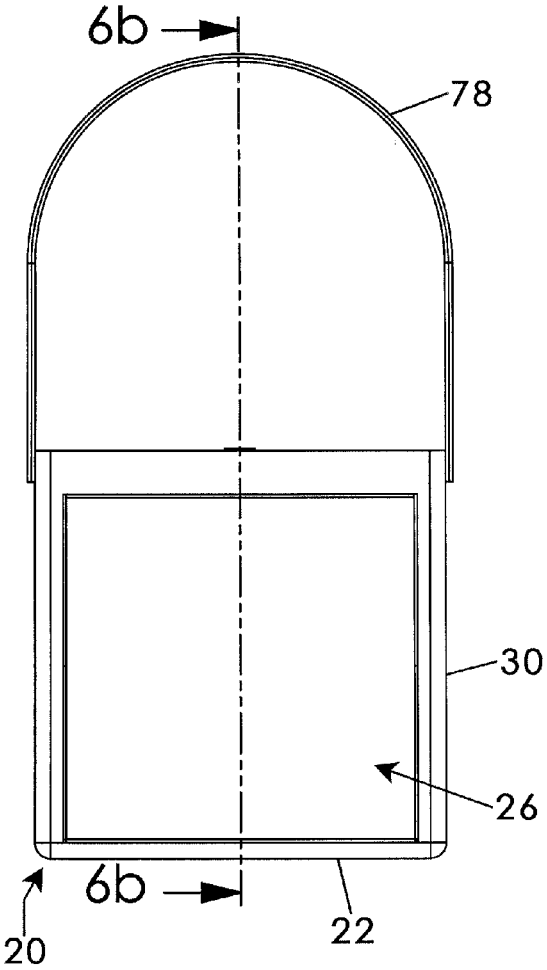
FIG. 6*a* is a front view of the accessory container as in FIG. 1.
Figure 6B:
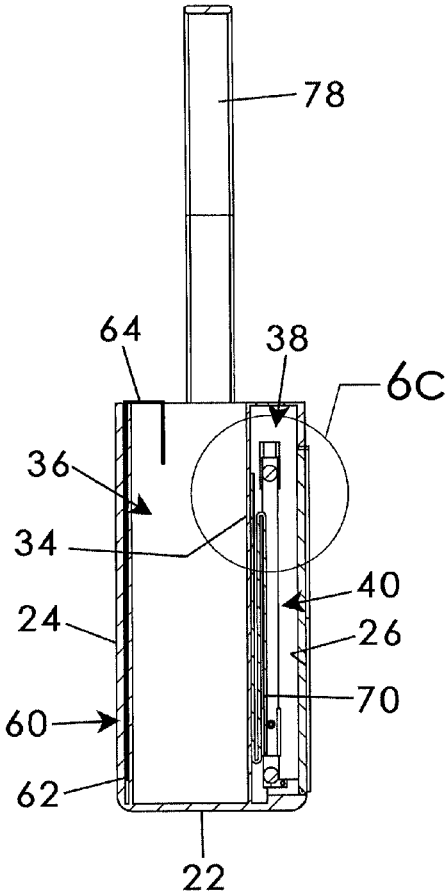
FIG. 6*b* is a sectional view taken along line 6*b*-6*b* of FIG. 6*a;*
Figure 6C:
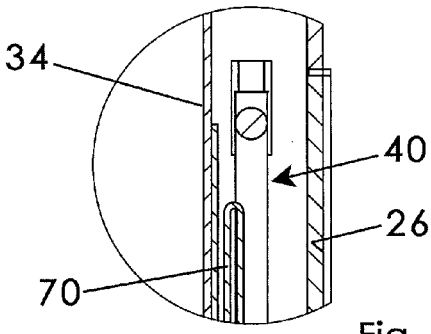
FIG. 6*c* is an isolated view on an enlarged scale taken from FIG. 6*b;*
Figure 13A:
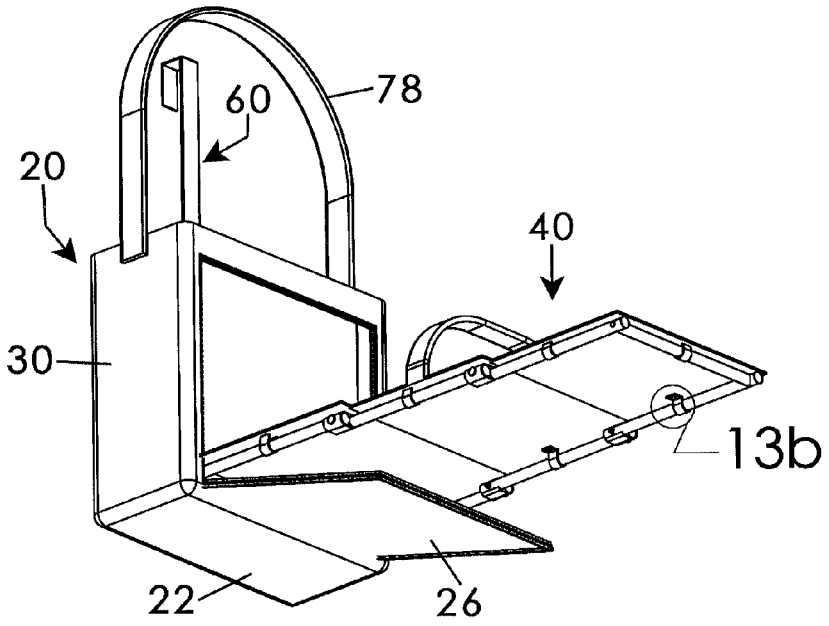
FIG. 13*a* is a perspective view from an underneath angle of the accessory container of FIG. 2.
Figure 13B:
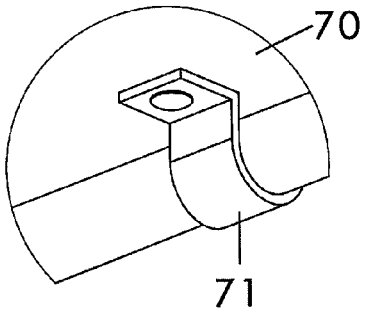
FIG. 13*b* is an isolated view on an enlarged scale taken from FIG. 13*a;*

As shown, the third section 56 may fold inwardly onto the second section 50 and both the second 50 and third 56 sections may fold inwardly onto the first section 42 when the frame assembly 40 is moved to the stowed configuration situated in the second chamber 38 (FIG. 6*b*). The sections are folded outwardly when the frame assembly 40 is moved to the deployed configuration (FIG. 2). In one embodiment, each section may include tubular frame members as opposed to full panels (FIG. 3). In this embodiment, a covering 70 having a flexible configuration may be coupled to the frame members so as to form a basket or hammock style surface suitable to hold or envelop an infant positioned thereon. The covering 70 may be a mesh type material. When fully deployed (FIG. 2), the covering 70 forms a generally planar surface on which to support an infant whose diaper is to be changed. The covering 70 may be removably coupled to the frame assembly 40 such as be snaps or other fasteners 71 (FIGS. 13*a* and 13*b*). When removed from the frame assembly 40, the covering 70 may be stowed in the second chamber 38 (FIG. 6*b*).

Figure 7:
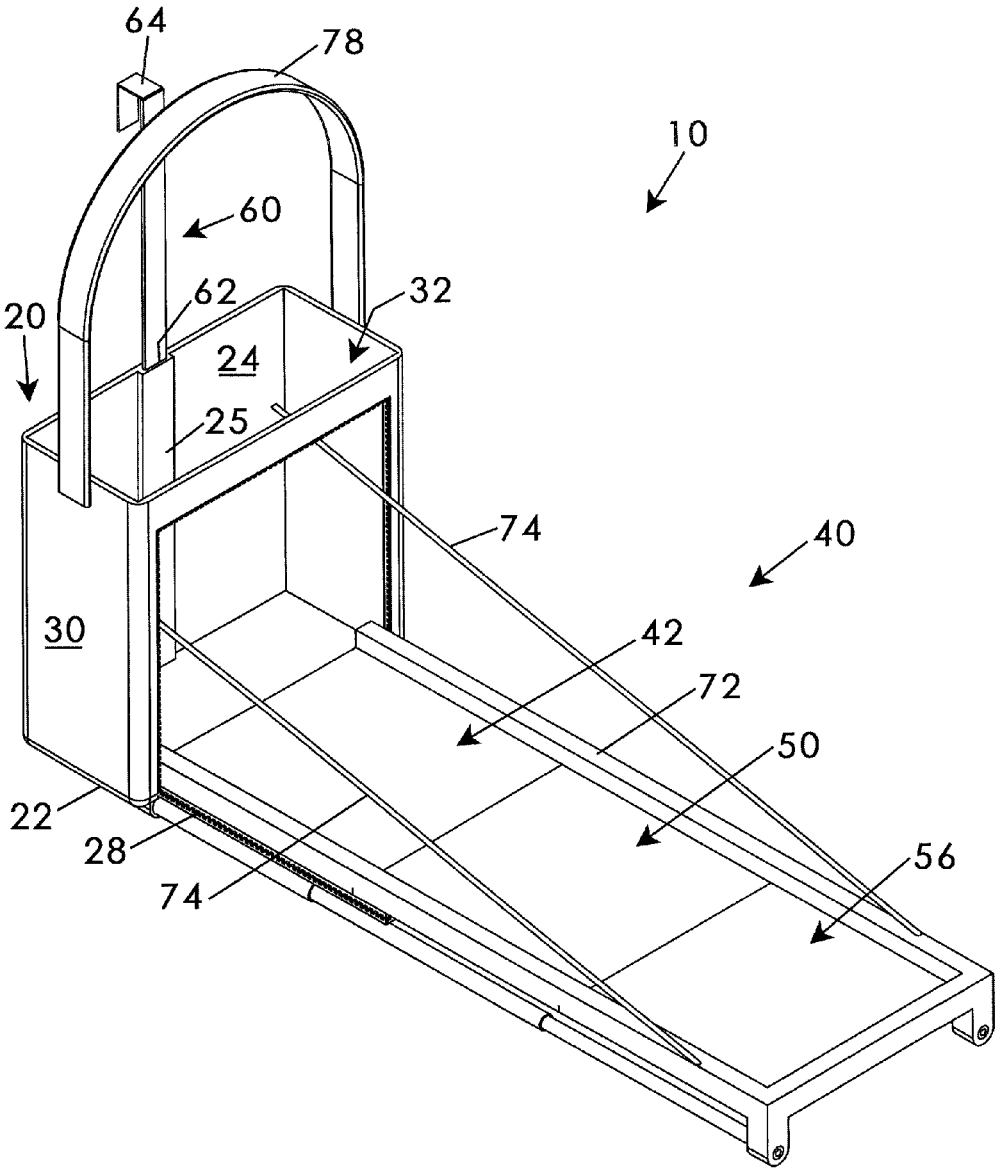
FIG. 7 is a perspective view of the accessory container with an alternative embodiment of the frame assembly and shown in a deployed configuration.
Figure 8A:
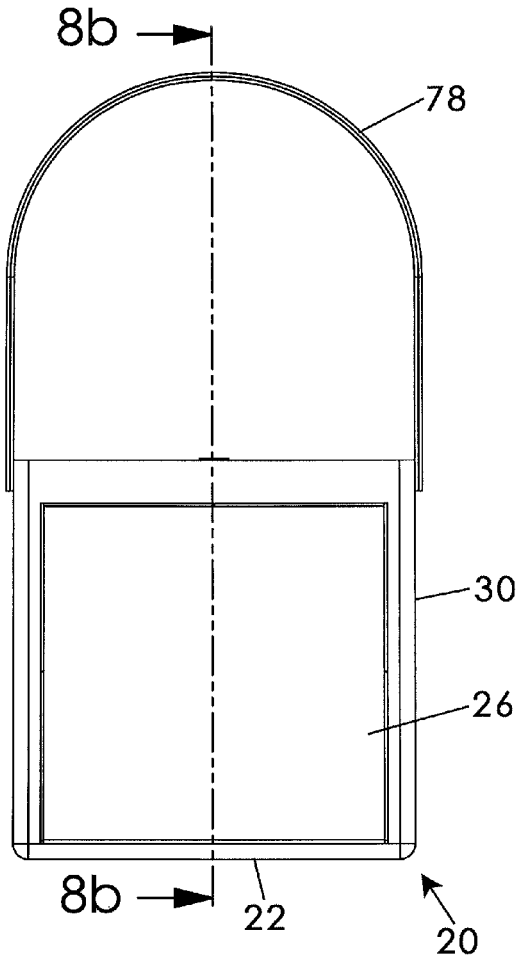
FIG. 8*a* is a front view of the accessory container as in FIG. 7.
Figure 8B:
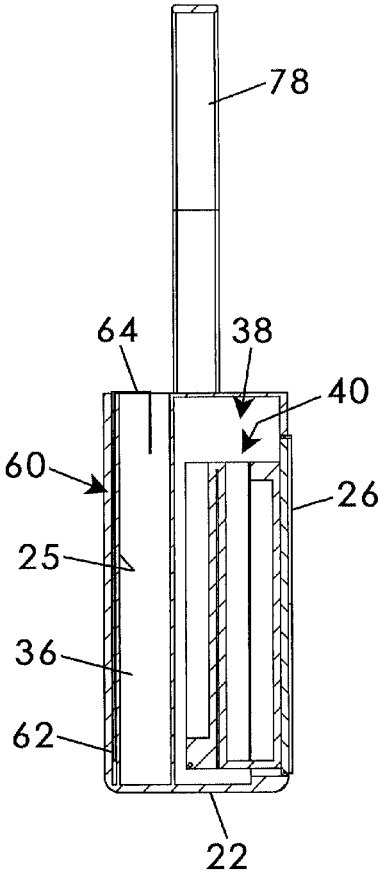
FIG. 8*b* is a sectional view taken along line 8*b*-8*b* of FIG. 8*a;*

In another embodiment, each section may include respective panels extending between respective sides thereof (FIG. 7). These panels may include a padded construction. The sections are also pivotally coupled to one another and are, therefore, foldable in a manner substantially similar to that described above. A protective rail member 72 may be coupled and extend about a peripheral edge of the frame assembly 40. The rail member 72 may extend upwardly so as to inhibit a baby from rolling or scooting off of the panels when deployed and, as a result, falling to the floor.

In one embodiment, at least one tether 74 may extend from the container member 20 to the furthest section of the frame assembly 40 (FIG. 1). More particularly, the tether 74 may include one end coupled to a wall of the container member 20 and another end coupled to a second end 59 of the third section 56 of the frame assembly 40. The tether 74, when fully extended, maintains the frame assembly 40 at the fully extended configuration such that the panels or covering 70 provide a planar surface to support an infant thereon for a diaper change.

Figure 9:
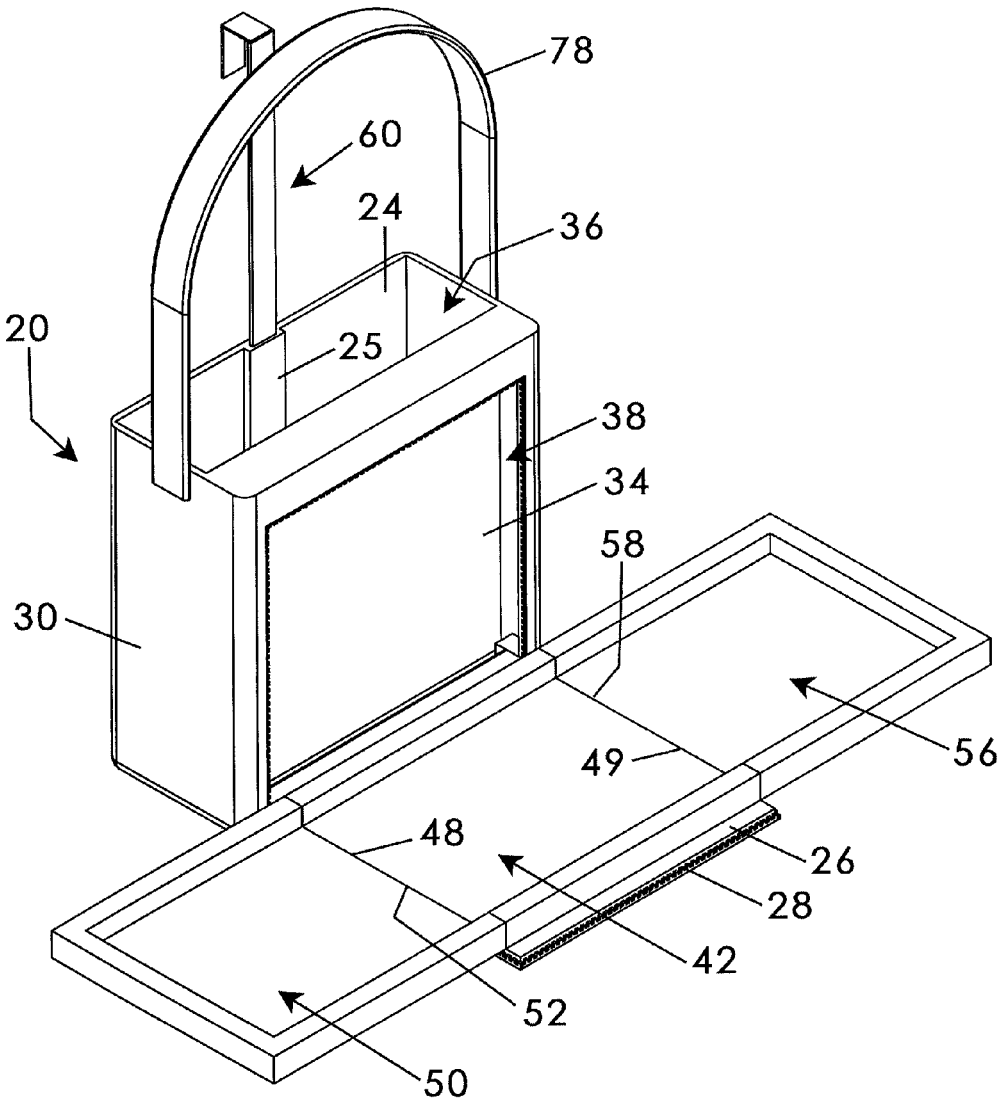
FIG. 9 is a perspective view of the accessory container with an alternative embodiment of the frame assembly and shown in a deployed configuration.
Figure 10:
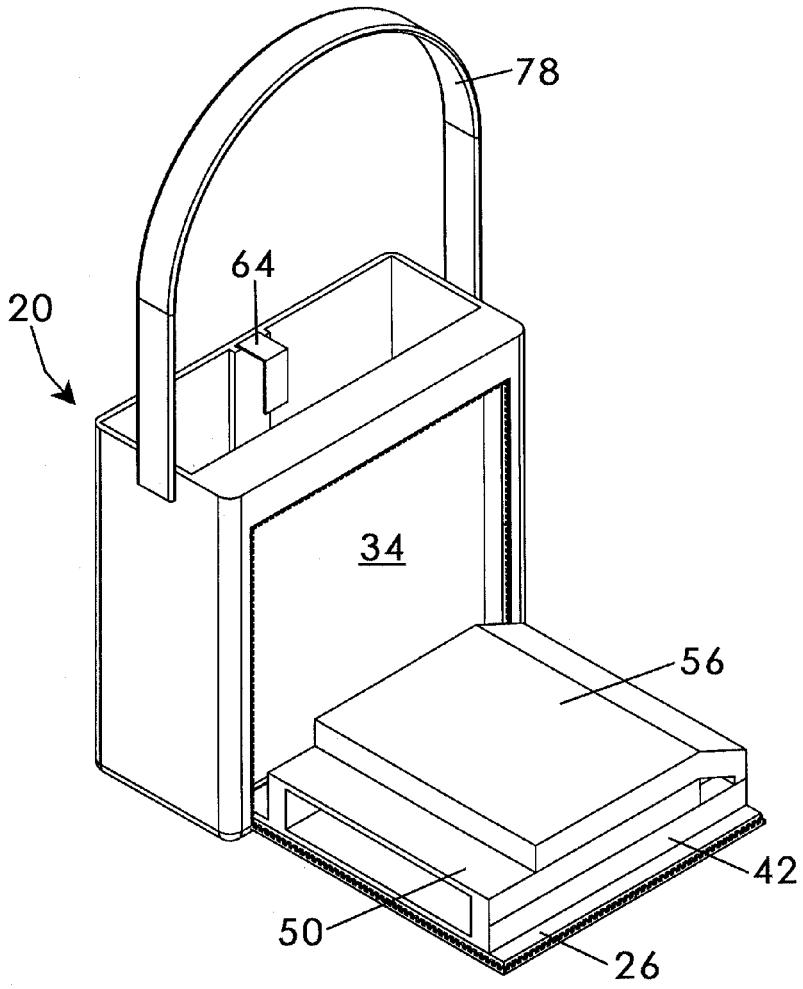
FIG. 10 is a perspective view of the accessory container as in FIG. 9 in a partially deployed configuration.

In another embodiment, illustrated in FIG. 9, the first end 52 of the second section 50 is pivotally coupled to a first side edge 48 of the first section 42 of the frame assembly 40 while the first end 58 of the third section 56 is pivotally coupled to a second side edge 49 of the first section 42 of the frame assembly 40 (FIG. 9). The second section 50 may be folded inwardly atop the first section 42 and the third section 56 may be folded atop the second section 50 at the stowed configuration (FIG. 10). It can be seen that this embodiment causes the frame assembly 40 to foldout side-to-side (laterally) as opposed to end-to-end (longitudinally) and may maintain better balance or less torque on the hook member 60 as will be described later.

Figure 11:
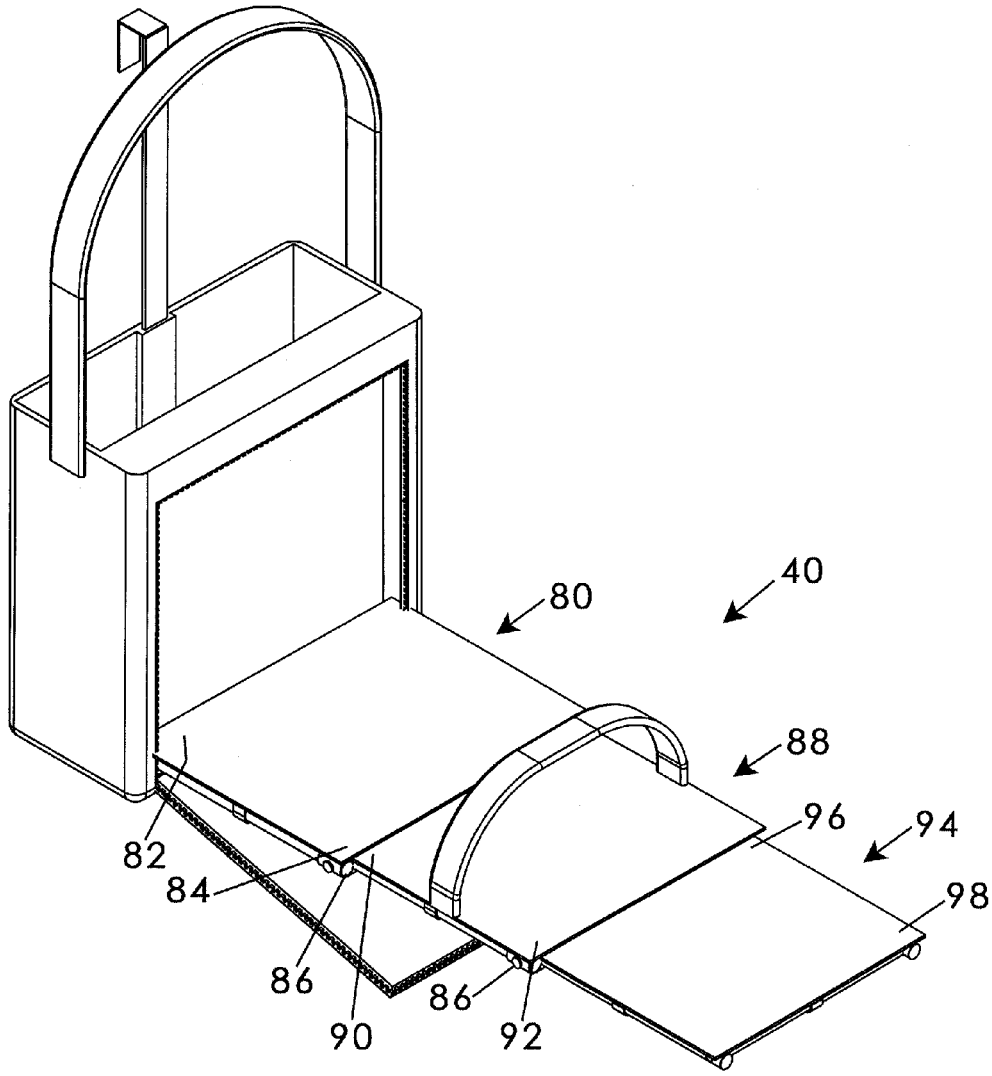
FIG. 11 is another perspective view of the accessory container with an alternative embodiment of the frame assembly and shown in a deployed configuration.
Figure 12A:
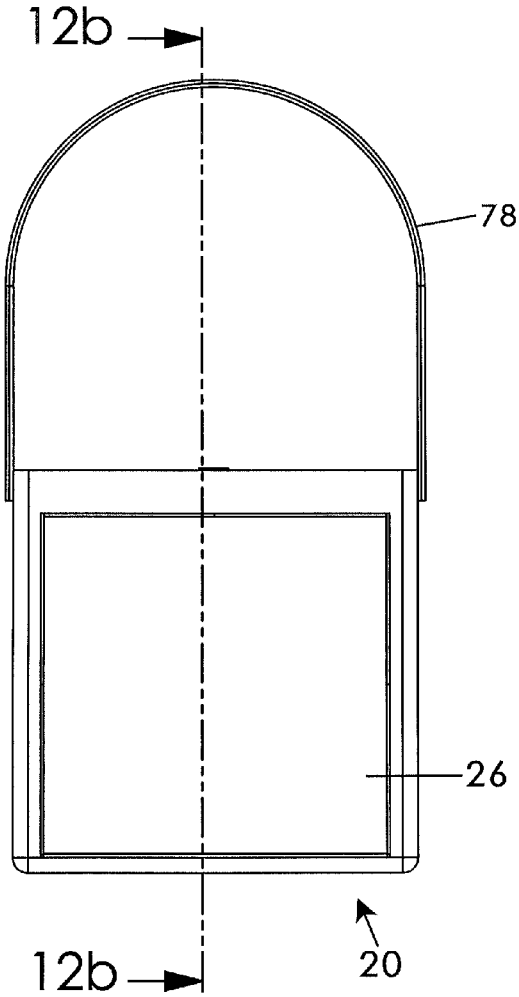
FIG. 12*a* is a front view of the accessory container as in FIG. 11.
Figure 12B:
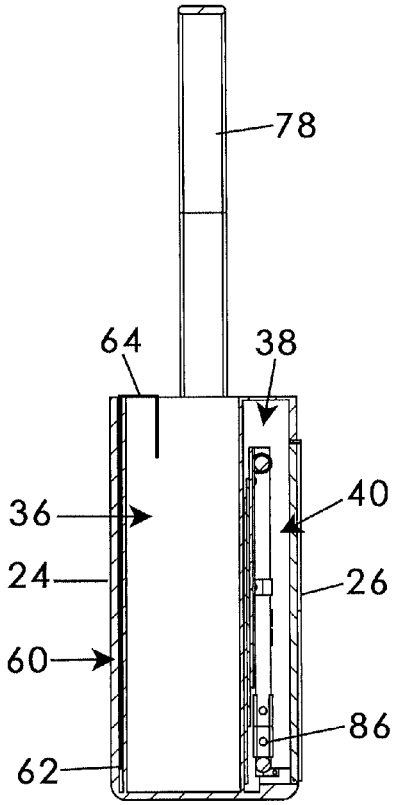
FIG. 12*b* is a sectional view taken along line 12*b*-12*b* of FIG. 12*a;*
Figure 14A:
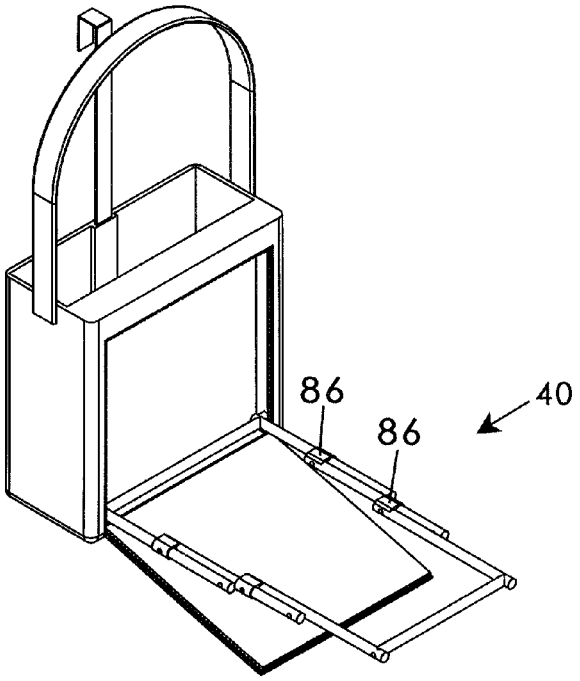
FIG. 14*a* is perspective view of the accessory container as in FIG. 11 shown in a partially deployed configuration.
Figure 14B:
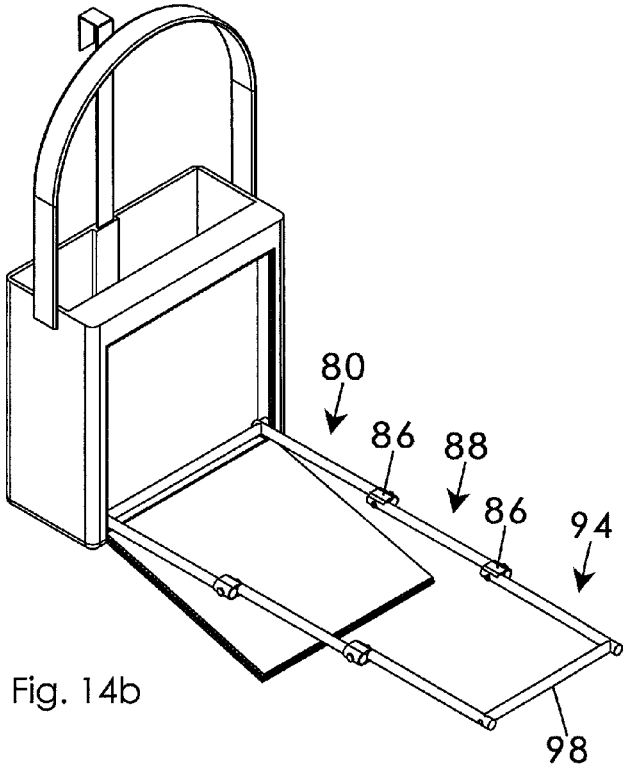
FIG. 14*b* is a perspective view of the accessory container as in FIG. 14*a* shown in a fully deployed configuration.

In yet another embodiment, the frame assembly 40 may include slidable sections. As best shown in FIGS. 11 and 14, the frame assembly 40 may include a first section 80 that includes opposed first 82 and second 84 ends as described previously. A second section 88 includes a first end 90 slidably coupled to the second end 84 of the first section 80 such as with wheel and rail combinations 86. The frame assembly 40 may include a third section 94 having a first end 96 slidably coupled to the second end 92 of the second section 88 such as with wheel and rail combinations 86 and a second end 98. It is understood that respective sections are configured to move slidably inwardly and outwardly between the stowed and deployed configurations, respectively, as discussed above.

Figure 4:
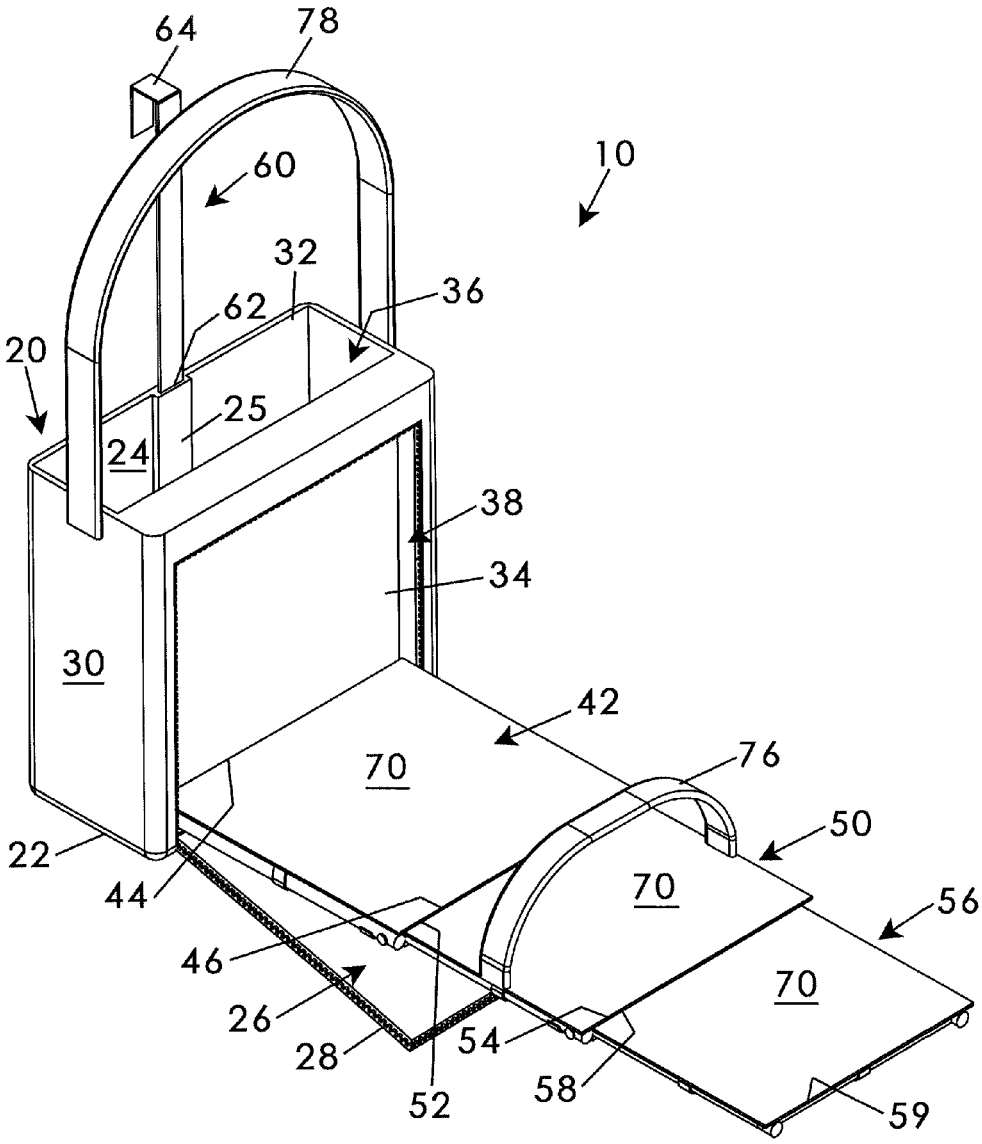
FIG. 4 is another perspective view of the accessory container shown in a deployed configuration and removed from the door or restroom stall panel.
Figure 5A:
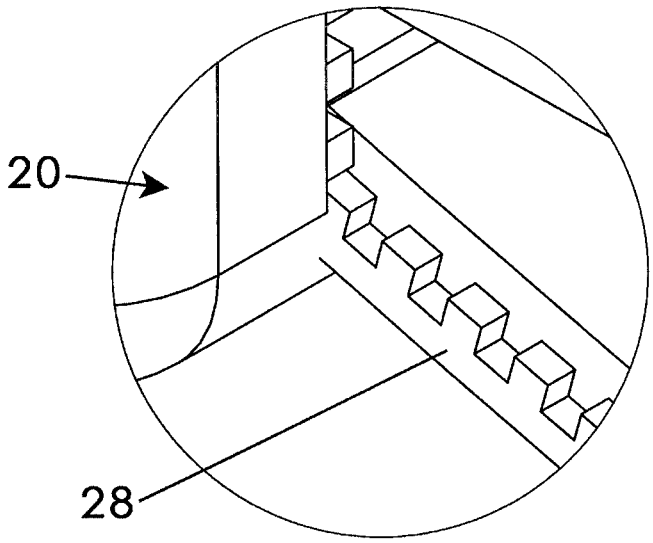
FIG. 5*a* is an isolated view on an enlarged scale taken from FIG. 2.
Figure 5B:
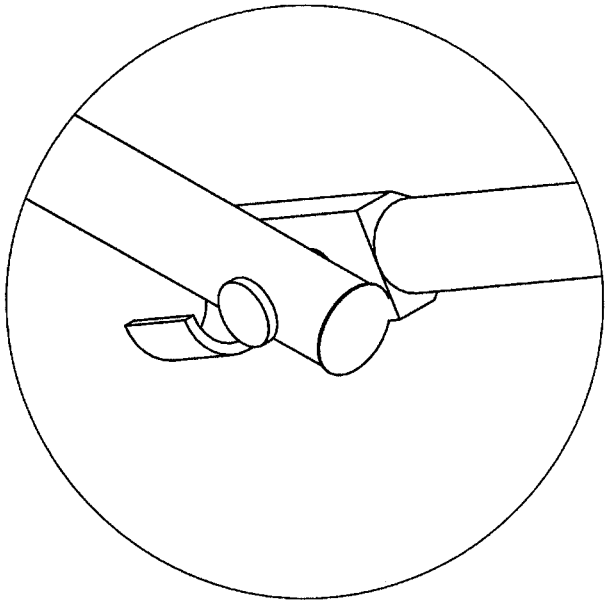
FIG. 5*b* is an isolated view on an enlarged scale taken from FIG. 3.

The accessory container 10 includes a safety belt 76 having opposed ends coupled to opposed sides of the frame assembly 40, respectively (FIG. 2). The safety belt 76 is configured to selectively secure an infant to a respective area of the frame assembly 40 while the infant's diaper is being changed, such as securing the infant to the covering 70 or to the panels, as the case may be. Preferably, the safety belt 76 is coupled to opposite sides of the second section 50 of the frame assembly 40 (FIG. 4).

In another aspect, the accessory container 10 may include a carrying strap 78 or handle having opposite ends coupled to upper ends of respective side walls 30 of the container member 20 (FIG. 1). The strap 78 is configured to enable a user to carry the accessory container 10, such as over the shoulder or in a user's hand.

In use, a user may choose a location at which to utilize the changing table frame assembly 40 of the accessory container 10 to change an infant's diaper. Specifically, the container member 10 may be suspended from a traditional door 12 or from the side panel of a public restroom stall (FIG. 2). The hook member 60 may be slidably extended upwardly so as to adjust the height of the container member 20 as desired. The front wall 26 may be moved to its open configuration to provide access to the frame assembly 40 and the frame assembly 40 may be moved to the deployed configuration as described above (FIG. 2). In one embodiment, the covering 70 may be positioned across the frame assembly 40 and coupled thereto (FIG. 13*a*). The frame assembly 40 is now configured as a changing table and is prepared to receive an infant in a supine position whereby to change the infant's diaper.

It is understood that while certain forms of this invention have been illustrated and described, it is not limited thereto except insofar as such limitations are included in the following claims and allowable functional equivalents thereof.

The invention claimed is:

1. A portable accessory container for carrying baby accessories and for changing a baby's diaper in conjunction with a door, comprising:

a container member having a bottom wall, a rear wall, a front wall opposite said rear wall, and opposed side walls extending between said front wall and said rear wall;

wherein said front, rear, and side walls extend upwardly from said bottom wall so as to define an interior area;

a divider panel positioned in said interior area of said container member so as to divide said interior area into first and second chambers;

wherein said front wall is movable between a closed configuration preventing access to said second chamber and an open configuration allowing access to said second chamber;

a length adjustable frame assembly having a first end mounted in said second chamber and that is selectively movable between a stowed configuration contained in said second chamber and an deployed configuration extending away from said second chamber; and a covering selectively mounted to said frame assembly configured to support a baby on said frame assembly;

a hook member having a proximal end coupled to said rear wall of said container member and movable between a retracted configuration substantially within said first chamber and an extended configuration extending away from said container member, said hook member having a distal end configured to selectively engage an upper edge of the door;

wherein said frame assembly comprises:

a first section that includes said frame assembly first end mounted in said second chamber and an opposed second end;

a second section having a first end pivotally coupled to a first side edge of said first section of said frame assembly and is configured such that said second section is selectively folded outward relative to said first section when said frame assembly is in said deployed configuration and is folded inward atop said first section when said frame assembly is in said stowed configuration; and a third section having a first end pivotally coupled to a second side edge of said first section of said frame assembly and is configured such that said third section is selectively folded outward relative to said first section when said frame assembly is in said deployed configuration and is folded inward atop said second section when said frame assembly is in said stowed configuration.

2. The accessory container as in claim 1, wherein said plurality of upright walls includes respective upper edges that define an open top through which said interior area of said first chamber is accessible.

3. The accessory container as in claim 1, wherein said front wall is held at said closed configuration with a zipper.

4. The accessory container as in claim 1, wherein said covering is a mesh material and is selectively removable from said frame assembly.

5. The accessory container as in claim 1, wherein said rear wall includes a channel that is configured to selectively receive said hook member such that said hook member is slidable in said channel between said retracted configuration and said extended configuration.

6. The accessory container as in claim 1, wherein said distal end of said hook member includes a generally inverted U-shaped configuration.

7. The accessory container as in claim 1, comprising a strap coupled to upper ends of respective side walls of said container member, said strap being configured to enable a user to carry said container member.

8. The accessory container as in claim 1, wherein said container member is constructed of a flexible material.

9. The accessory container as in claim 1, comprising a safety belt coupled to opposed sides of said frame assembly and configured to selectively secure a baby to said covering of said frame assembly.

10. The accessory container as in claim 1, wherein said hook member includes a telescopic construction.

11. The accessory container as in claim 1, comprising a rail member coupled to a peripheral edge of said frame assembly and extending upwardly therefrom, said rail member having a configuration to resist a baby inadvertently rolling off of said covering.

* * * * *